US010954780B2

(12) United States Patent
Ge et al.

(10) Patent No.: US 10,954,780 B2
(45) Date of Patent: Mar. 23, 2021

(54) ECCENTRICITY CORRECTION ALGORITHM FOR BOREHOLE SHAPE AND TOOL LOCATION COMPUTATIONS FROM CALIPER DATA

(71) Applicant: Halliburton Energy Services, Inc., Houston, TX (US)

(72) Inventors: Yao Ge, Singapore (SG); Jing Jin, Singapore (SG); Xiang Wu, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/473,429

(22) PCT Filed: Aug. 14, 2018

(86) PCT No.: PCT/US2018/046780
§ 371 (c)(1),
(2) Date: Jun. 25, 2019

(87) PCT Pub. No.: WO2020/036596
PCT Pub. Date: Feb. 20, 2020

(65) Prior Publication Data

US 2020/0400015 A1 Dec. 24, 2020

(51) Int. Cl.
*E21B 47/14* (2006.01)
*E21B 47/08* (2012.01)
*E21B 47/09* (2012.01)

(52) U.S. Cl.
CPC ..... *E21B 47/14* (2013.01); *E21B 47/08* (2013.01); *E21B 47/09* (2013.01)

(58) Field of Classification Search
CPC ..... E21B 47/08; E21B 47/085; E21B 47/09; E21B 47/095; E21B 47/14
See application file for complete search history.

(56) References Cited

U.S. PATENT DOCUMENTS 4,463,378 A 7/1984 Rambow
4,803,667 A 2/1989 Siegfried, II
(Continued)

FOREIGN PATENT DOCUMENTS

WO 2000000845 1/2000
WO 2009039468 3/2009

OTHER PUBLICATIONS

ISRWO International Search Report and Written Opinion for PCT/US2018/046780 dated May 10, 2019.
(Continued)

*Primary Examiner* — Christopher J Sebesta
(74) *Attorney, Agent, or Firm* — Benjamin Ford; C. Tumey Law Group PLLC

(57) ABSTRACT

The subject disclosure provides for a method of eccentricity correction of a borehole shape computation. The method includes deploying a caliper tool into a borehole penetrating a subterranean formation and acquiring field measurements with the deployed caliper tool. The method includes applying, in a processor circuit, an eccentricity correction algorithm to one or more standoff samples from the obtained field measurements, wherein the eccentricity correction algorithm produces a shape fitted curve that represents a measured borehole with a least number of points outside of the shape fitted curve and a least amount of error. The method includes determining eccentricity-corrected borehole coordinates with the applied eccentricity correction algorithm and determining a borehole shape from the eccentricity-corrected borehole coordinates. The method includes determining tool location coordinates relative to the borehole with the determined borehole shape.

17 Claims, 9 Drawing Sheets

(56) References Cited

U.S. PATENT DOCUMENTS

| | | | | |
|---|---|---|---|---|
| 4,867,264 | A * | 9/1989 | Siegfried | G01V 1/46 181/105 |
| 6,065,219 | A * | 5/2000 | Murphey | E21B 47/085 33/544 |
| 7,389,828 | B2 | 6/2008 | Ritter et al. | |
| 7,966,874 | B2 | 6/2011 | Hassan et al. | |
| 9,605,938 | B2 | 3/2017 | Helmore | |
| 2005/0259512 | A1* | 11/2005 | Mandal | E21B 47/085 367/10 |
| 2005/0283315 | A1* | 12/2005 | Haugland | E21B 47/095 702/6 |
| 2013/0030705 | A1 | 1/2013 | Pei et al. | |
| 2017/0082767 | A1* | 3/2017 | Jesus | G01V 1/44 |
| 2017/0322332 | A1 | 11/2017 | Cooper et al. | |

OTHER PUBLICATIONS

Tu et al. "A New Correction Algorithm of the Eccentric Ultrasonovision Time Image in the Casing Hole." American Mathematics. 2014.

* cited by examiner

ECCENTRICITY CORRECTION ALGORITHM FOR BOREHOLE SHAPE AND TOOL LOCATION COMPUTATIONS FROM CALIPER DATA

TECHNICAL FIELD

The present description relates in general to downhole measurement systems, and more particularly to, for example, without limitation, eccentricity correction algorithm for borehole shape and tool location computations from caliper data.

BACKGROUND

Modern oil field operations demand a great quantity of information relating to the parameters and conditions encountered downhole. Such information typically includes characteristics of the earth formations traversed by the borehole, and data relating to the size and configuration of the borehole itself. The collection of information relating to conditions downhole, which commonly is referred to as "logging," can be performed by several methods including wireline logging and "logging while drilling" (LWD).

During exploration and recovery operations, the standoff data of the borehole may be used as an indication of formation stress, compaction, and other mechanisms that operate to deform the borehole. In these and other logging environments, an image of the borehole wall can be constructed with the standoff data. Among other things, such images reveal the fine-scale structure of the penetrated formations. However, assessing the standoff data of the borehole rapidly and accurately, especially when the logging tool acquiring the associated data moves off-center, can be difficult.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
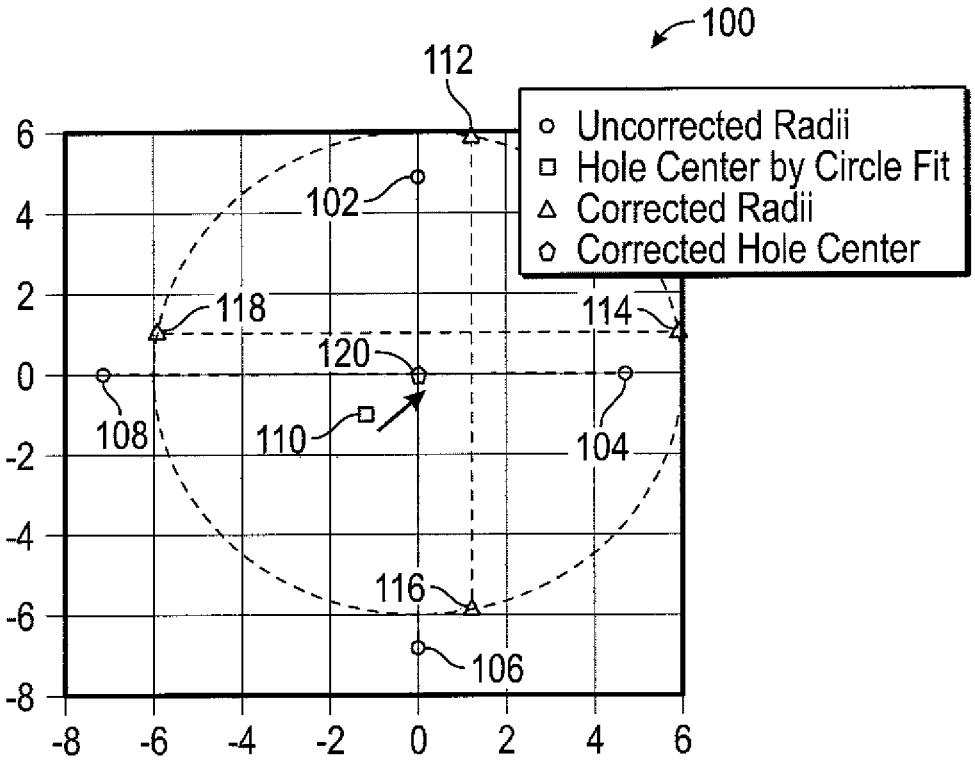
FIG. 1A illustrates an example of a data plot depicting an eccentricity correction algorithm using a traditional approach.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Borehole standoff measurements can be made in many ways. Traditional approaches include mechanical devices that follow the contour of the borehole and acoustic/ultrasonic devices that measure the time it takes pressure waves to travel from the tool to the formation wall and back. Caliper logs can provide information about borehole geometry, which is important in petrophysical and geomechanical analyses. When using a caliper device for borehole standoff measurement for both wireline and logging-while-drilling, it is common that the tool string is off-centered. It is important to have a robust algorithm to correct the tool eccentricity in order to recover the correct hole shape.

The disclosed system addresses a problem in traditional borehole shape computation algorithms tied to computer technology, namely the technical problem of computing a borehole shape when a borehole wall perimeter is irregular. One of the challenges of LWD ultrasonic borehole imaging is to correct the eccentricity of the tool. It is important to determine the accurate tool location with respect to the borehole during each data acquisition and from which recover the borehole shape. A robust algorithm is crucial for this technology because an accurate tool center and borehole shape is expected to correct the amplitude of an image due to eccentricity. Traditional methods use least-square circle fitting or elliptical fitting, which yield an inaccurate borehole shape when the borehole is irregular (e.g. breakout, keyseat).

The present disclosure provides for computing the borehole shape with more accuracy over conventional approaches with the eccentricity correction borehole shape computation algorithm of the subject technology, especially for irregular borehole shapes such as keyseat or breakout. For example, the subject eccentricity correction algorithm is robust in handling irregular borehole shapes and is able to recover irregular hole shape with relatively high accuracy. In some implementations, the subject eccentricity correction borehole shape algorithm can be used for ultrasonic imager, ultrasonic caliper, mechanical caliper and other types of calipers. In some implementations, the eccentricity correction borehole shape algorithm can be used for calipers with more or less than 4 transceivers (or mechanical arms). The subject eccentricity correction borehole shape algorithm also works for wireline calipers and LWD calipers, for example, a 6-arm wireline caliper.

Conventional methods such as circle fitting or elliptical fitting methods only employ minimization of error. However, the subject algorithm employs a comprehensive list of assumptions and criteria to compute borehole shape from caliper data with high accuracy. For example, 1) a portion of intact borehole exists, where borehole irregularity is caused by attachment or removal of material from a gauge hole while part of the gauge hole remains intact, 2) adjacent firings are stacked, where the borehole shape remains unchanged within a small depth interval and the fitted borehole radius from several adjacent firings is a constant, 3) points out of the fitted circle shape are minimized, where the correct fitted circular borehole minimizes the number of points out of the circle or maximizes the number of points on the circle, and 4) the error is minimized, where the correct fitted circular borehole minimizes the difference between the square of the corrected radius and the square of the circular borehole radius.

The disclosed system further provides improvements to the functioning of the computer itself because it saves data storage space, reduces system processing latency and reduces the cost of system resources. Specifically, the eccentricity-corrected borehole shape computations helps reduce the system processing latency by computing the borehole shape with standoff measurements produced by adjacently stacked transducer firings without the need to execute individual computations for each transducer firing while logging and/or after the logging has been completed. The borehole shape computations can be stored and indexed by depth interval with minimal storage required due to the lesser amount of data generated from the adjacently stacked transducer firings. The process of adjacently stacking transducer firings for a given depth interval also helps to reduce the cost of system resources by minimizing the need to reallocate additional memory bandwidth for processing standoff measurements after each individual transducer firing.

The subject disclosure provides for a method of eccentricity correction of a borehole shape computation. In some implementations, the method includes deploying a caliper tool into a borehole penetrating a subterranean formation and acquiring field measurements with the deployed caliper tool. The method includes applying, in a processor circuit, an eccentricity correction algorithm to one or more standoff samples from the obtained field measurements, wherein the eccentricity correction algorithm produces a shape fitted curve that represents a measured borehole with a least number of points outside of the shape fitted curve and a least amount of error. The method includes determining eccentricity-corrected borehole coordinates with the applied eccentricity correction algorithm and determining a borehole shape from the eccentricity-corrected borehole coordinates. The method also includes determining tool location coordinates relative to the borehole with the determined borehole shape.

As used herein, the terms "firing" or "transducer firing" generally refer to a transmitted signal pulse by a transducer to produce a signal reflection with a borehole wall for measurement. In some aspects, the signal pulse and signal reflection are acoustic wave signals, where the transducer may be an acoustic transducer. In other aspects, the signal pulse and signal reflection are gamma ray signals, where the transducer may be a nuclear transducer. As used herein, the term "adjacent firing" refers to the adjacency of the transmitted transducer signal pulses in space and time. As used herein, the term "borehole shape" refers to the shape outline of the borehole wall perimeter.

FIG. 1A illustrates an example of a data plot 100 depicting an eccentricity correction algorithm using a traditional approach. The traditional eccentricity correction algorithm uses mainly two assumptions. First, the borehole is stationery and the caliper tool moves at different acquisitions. Second, the borehole is approximately circular in shape. The hole center can be estimated using circle fitting and the radii are corrected by shifting the hole center to the origin of the circle fitted shape.

In FIG. 1A, the circles (e.g., 102, 104, 106, 108) are raw data computed from borehole standoff data and the angle of firing. The point (e.g., 110) is the estimated hole center based on circle fitting. The triangles (e.g., 112, 114, 116, 118) are eccentricity-corrected radii and the point (e.g., 120) is an eccentricity-corrected hole center.

In the traditional eccentricity correction algorithm, the circle fitting can be achieved in various ways such as least-squared circle fitting or chord method. For a caliper tool with more than four transceivers (or arms for mechanical caliper), an ellipse fitting method can be used. However, these fitting methods work best for a near-circular or near-elliptical borehole. When the borehole shape is irregular, the assumption fails and the method would result in an inaccurate hole shape.

Figure 1B:
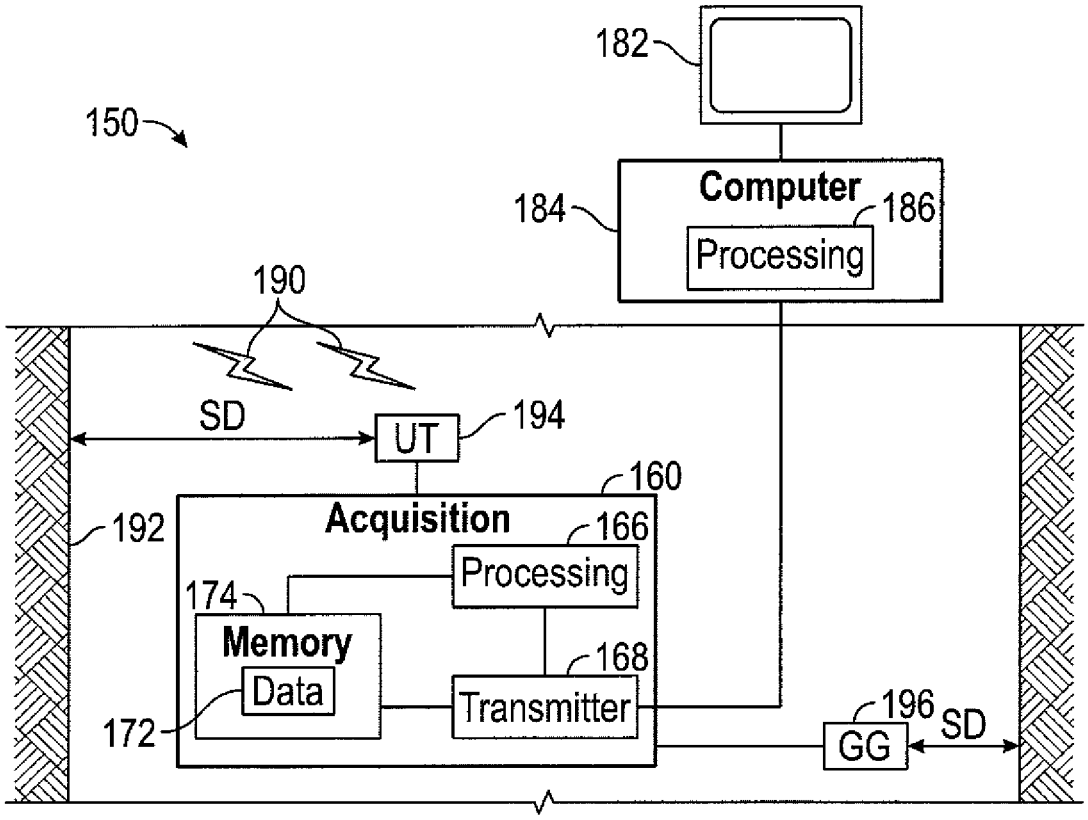
FIG. 1B illustrates an example of a caliper measurement apparatus in accordance with one or more implementations of the subject technology.

To implement the mechanisms described for determining a borehole caliper measurement, a variety of apparatus, systems, and methods may be used. For example, FIG. 1B illustrates a caliper measurement apparatus 150 according to various implementations of the subject technology. In some implementations, the caliper measurement apparatus 150 may include one or more sensors 194 (e.g., ultrasound sensors) to receive signals 190. In the subject disclosure, a 4-transceiver ultrasonic caliper tool is used as an example. However, the subject disclosure also applies to other types of caliper tools with more or less number of transceivers or mechanical calipers.

The caliper measurement apparatus 150 may include acquisition logic 160 (e.g., acquisition logic circuitry) to acquire data 172, such as azimuthal location data, signals 190, and/or borehole standoff distance data representing the standoff distance between a transducer 194 and a borehole 192. That is, the acquisition logic 160 may acquire the ultrasonic signals 190 directly as borehole standoff data, or digitize the signals 190 to provide digital borehole standoff data, to record information representing borehole standoff distance measurements. The sensor 194 may include a single rotating transducer to couple to the acquisition logic 160 to provide the borehole standoff data. In some implementations, the caliper measurement apparatus 150 may include a gamma-ray density tool 196 to couple to the acquisition logic 160 to provide the borehole standoff data. In some aspects, the transducer 194 is an acoustic transducer. In particular, the transducer 194 may be an ultrasonic acoustic transducer. In implementations, the transducer 194 includes an array of transducers. In this respect, the array of transducers can be deployed and fire simultaneously at different angles of firing in a depth interval.

Figure 2:
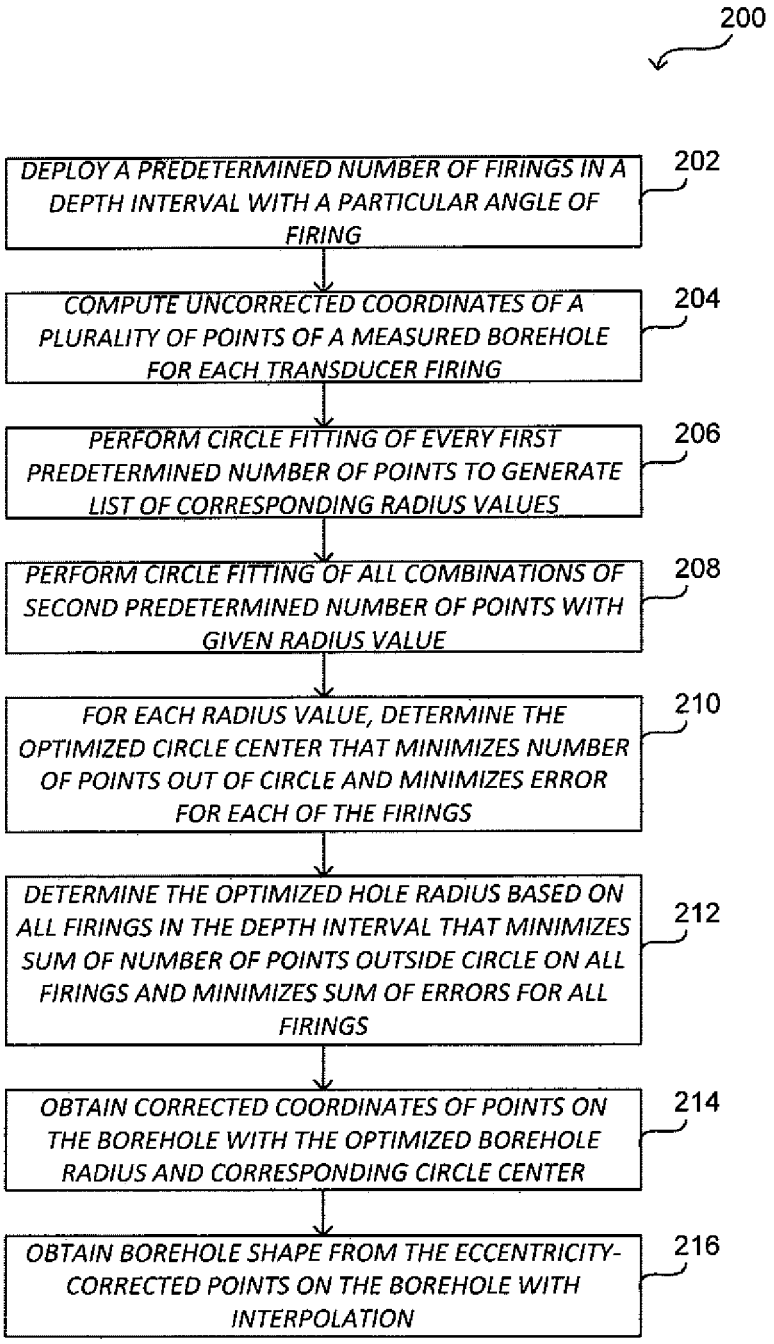
FIG. 2 illustrates a flowchart of a process for an eccentricity correction algorithm in accordance with one or more implementations of the subject technology.

The caliper measurement apparatus 150 may also include a memory 174 to store the data 172. The caliper measurement apparatus 150 may also include processing logic 166 to perform the steps of process 200 (FIG. 2). In some implementations, the processing logic 116 may operate to calibrate caliper measurement values. The processing logic 116 may be included in a downhole tool, or above-ground (e.g., as part of an above-ground computer workstation, perhaps located in a logging facility), or both.

In some implementations, the caliper measurement apparatus 150 may include one or more transmitters 168, such as telemetry transmitters, to transmit the data 172 to an above-ground computer 184. For example, one or more transmitters may be used to transmit caliper measurements, including corrected caliper measurement data, to the surface (e.g., above ground), where the above-ground computer 184 is located. The caliper measurement apparatus 150 may also include one or more displays 182 to display visual representations of caliper measurements, including corrected caliper measurement data and/or uncorrected caliper measurement data.

The process 200 will be discussed in reference to FIG. 1B for brevity and explanation. Further for explanatory purposes, the blocks of the sequential process 200 are described herein as occurring in serial, or linearly. However, multiple blocks of the process 200 may occur in parallel. In addition, the blocks of the process 200 need not be performed in the order shown and/or one or more of the blocks of the process 200 need not be performed. In some aspects, the process 200 is performed during a logging operation (e.g., LWD, MWD, wireline logging). In other aspects, the process 200 is partially performed during a logging operation (e.g., transducer firings deployed, field measurements are obtained) and the processing of the measurement data is performed on a surface as a post-processing operation.

As shown in FIG. 2, the caliper measurement apparatus 150 may cause deployment of a predetermined number of firings in a depth interval with a particular angle of firing (202). In some aspects, the angle of firing may be in a range of 0 to 360 degrees, and the angle of firing of each adjacent firing may be different from one another. The depth interval may include a range of depth values in some implementations, or may include a single depth value in other implementations.

In some aspects, the caliper measurement apparatus 150 obtains field measurements from the acquisition logic 160. In particular, the caliper measurement apparatus 150 may acquire a standoff measurement for each transducer firing in the depth interval from the obtained field measurements. In other aspects, the caliper measurement apparatus 150 may acquire an angle of firing measurement for each transducer firing in the depth interval from the obtained field of measurements.

The caliper measurement apparatus 150 also computes uncorrected coordinates of a plurality of points of the measured borehole for each transducer firing (204). In some aspects, the uncorrected coordinates are computed using the standoff measurements and angle of firing measurements in the depth interval.

In some implementations, the caliper measurement apparatus 150 applies an eccentricity correction algorithm. The eccentricity correction algorithm employs two main assumptions: (1) the presence of a partial intact borehole, and (2) the stacking of adjacent transducer firings. With regard to the assumption of the presence of a partial circular intact hole, the borehole irregularity is assumed to be caused by attachment or removal of material from an intact gauge hole, such as keyseat, breakout, drilling-induced fracture, mudcake attachment, etc. A portion of the circular gauge hole remains intact, which can be used to calculate the hole diameter. With regard to the assumption of the stacking of adjacent firings, the borehole shape is assumed to remain unchanged within a small depth interval. In this respect, the borehole radius of the intact section from several adjacent firings is a constant. When only one firing is considered, the intact hole radius cannot be identified when two or more transceivers fire onto the non-intact section of the borehole. The stacking of adjacent firings improves the rate of finding the correct borehole radius and enables the corrected borehole shape to reveal more detailed features by including more data points.

The caliper measurement apparatus 150 performs circle fitting of every first predetermined number of points to generate a list of corresponding radius values (206). In particular, the caliper measurement apparatus 150 applies a shape fitting algorithm (e.g., circle fitting algorithm). In some aspects, the list of radius values correspond to an intact section of the measured borehole. In some aspects, the measured borehole includes an intact section and a non-intact section, where part of the borehole is enlarged or shrunk due to a downhole event (e.g., breakout, keyseat, mudcake attachment, etc.).

The caliper measurement apparatus 150 performs circle fitting of all combinations of second predetermined number of points with a given radius value (208). In particular, the caliper measurement apparatus 150 applies a shape fitting algorithm (e.g., circle fitting) to all combinations of every 2 points with a radius value of the listing of radius values to compute a plurality of hole centers.

The eccentricity correction algorithm also employs the following criteria to find the best fitting circular intact borehole: (1) by minimizing points out of the circle, and (2) by minimizing the error. Regarding the first criterion, the correct fitted circular borehole minimizes the number of points out of the circle or maximizes the number of points on the circle.

This is the main objective function and can be expressed using an L0-norm optimization algorithm, which is expressed as shown in Equation (1):

$$C_j = \sum_{i=1}^{4} \|(x_{ij} - x_{0j})^2 + (y_{ij} - y_{0j})^2 - R^2\|_0 \quad \text{Equation (1)}$$

where i is the transceiver number, j is the firing number, (xij,yij) is the point on the borehole corresponding to ith transceiver in jth firing, (x0j,y0j) is the coordinate for the fitted hole center for jth firing, R is the hole radius of the intact circular section where Cj is the number of points on the circle for jth firing. However, the value of the function (number of points) is discrete. There are possibly multiple solutions with the same number of points out of circle. Hence the second minimization condition is used to arrive at a unique solution.

In some implementations, in maximizing the number of points on the shape fitted curve (i.e., minimizing the number of points out of the shape fitted curve using the L0-norm optimization algorithm, the caliper measurement apparatus 150 determines a first magnitude measurement (e.g., xij) of a transducer firing along a first axis (e.g., x-axis) for each of a plurality of transducers (e.g., ith transceiver) associated with one of a plurality of transducer firings (e.g., jth firing). The caliper measurement apparatus 150 also determines a first hole center estimation of the shape fitted curve along the first axis (e.g., x0j) for each of the plurality of transducers associated with the one of the plurality of transducer firings. The caliper measurement apparatus 150 also determines a first difference between the first magnitude measurement and the first hole center estimation (e.g., xij−x0j). The caliper measurement apparatus 150 also determines a second magnitude measurement (e.g., yij) of a transducer firing along a second axis (e.g. y-axis) orthogonal to the first axis for each of the plurality of transducers associated with the one of the plurality of transducer firings. The caliper measurement apparatus 150 also determines a second hole center estimation of the shape fitted curve along the second axis (e.g., y0j) for each of the plurality of transducers associated with the one of the plurality of transducer firings. The caliper measurement apparatus 150 also determines a second difference between the second magnitude measurement and the second hole center estimation (e.g., yij−y0j). The caliper measurement apparatus 150 also determines a sum of a square of the first difference and a square of the second difference (e.g., $(xij-x0j)^2+(yij-y0j)^2$). The caliper measurement apparatus 150 also determines a third difference between the determined sum and a square of a hole radius of an intact section of the shape fitted curve to produce a first solution vector (e.g., $(xij-x0j)^2+(yij-y0j)^2-R^2)$). The caliper measurement apparatus 150 also applies an L0-norm optimization algorithm to the first solution vector for each of the plurality of transducer firings to maximize the number of points on the shape fitted curve (or minimize the number of points on the shape fitted curve). In some aspects, the determined number of points corresponds to the maximized number of data points on the shape fitted curve (e.g., circle).

Regarding the second criterion, the correct fitted circular borehole minimizes the difference between the square of measured radius and the square of circular borehole radius, which is expressed as shown in Equation (2):

$$f_j = \sum_{i=1}^{4} |(x_{ij} - x_{0j})^2 + (y_{ij} - y_{0j})^2 - R^2|^2 \quad \text{Equation (2)}$$

In some implementations, other optimization methods can be employed to solve (x0j,y0j) and R based on the above conditions.

In some implementations, in minimizing the amount of error for each transducer firing, the caliper measurement apparatus 150 determines a first magnitude measurement (e.g., xij) of a transducer firing along a first axis (e.g., x-axis) for each of a plurality of transducers (e.g., ith transceiver) associated with one of a plurality of transducer firings (e.g., jth firing). The caliper measurement apparatus 150 also determines a first hole center estimation of the shape fitted curve along the first axis (e.g., x0j) for each of the plurality of transducers associated with the one of the plurality of transducer firings. The caliper measurement apparatus 150 also determines a first difference between the first magnitude measurement and the first hole center estimation (e.g., xij−x0j). The caliper measurement apparatus 150 also determines a second magnitude measurement (e.g., yij) of a transducer firing along a second axis (e.g. y-axis) orthogonal to the first axis for each of the plurality of transducers associated with the one of the plurality of transducer firings. The caliper measurement apparatus 150 also determines a second hole center estimation of the shape fitted curve along the second axis (e.g., y0j) for each of the plurality of transducers associated with the one of the plurality of transducer firings. The caliper measurement apparatus 150 also determines a second difference between the second magnitude measurement and the second hole center estimation (e.g., yij−y0j). The caliper measurement apparatus 150 also determines a sum of a square of the first difference and a square of the second difference (e.g., $(xij-x0\ j)^2+(yij-y0j)^2$). The caliper measurement apparatus 150 also determines a third difference between the determined sum and a square of a hole radius of an intact section of the shape fitted curve to produce a second solution vector (e.g., $(xij-x0\ j)^2+(yij-y0j)^2-R^2)$). The caliper measurement device applies a square to an absolute value of the second solution vector for each of the plurality of transducer firings to minimize the amount of error on the shape fitted curve.

Referring back to FIG. 2, the caliper measurement apparatus 150 selects one of the hole centers for each corresponding radius value that minimizes the number of points outside of the shape fitted curve (e.g., circle) and minimizes the error for each of the transducer firings (210). In other words, the shape fitted curve with its origin at the selected hole center that has the least number of points outside the curve and least amount of error is selected. This process would be repeated for each round of transducer firing.

The caliper measurement apparatus 150 selects a radius value from the listing of radius values associated with the selected hole center having the least sum of points outside the shape fitted curve for all transducer firings and a least sum of errors for all transducer firings (212). With the selected radius value and the selected hole center, the caliper measurement apparatus 150 determines coordinates of eccentricity-corrected points on a representation of the measured borehole (214). The caliper measurement apparatus 150 interpolates additional data points using the eccentricity-corrected points in order to compute a representation of the borehole shape for the measured borehole (216).

In FIG. 2, two criteria are used for the optimization of the eccentricity correction algorithm. In some implementations, a selection of the two criterion in any number or order can be used while effectiveness of the algorithm may be affected. For example, criterion 1 (minimizing points out of the circle) can be satisfied first before criterion 2 (minimizing error). The reverse may also work but with a higher rate of error.

Figure 3A:
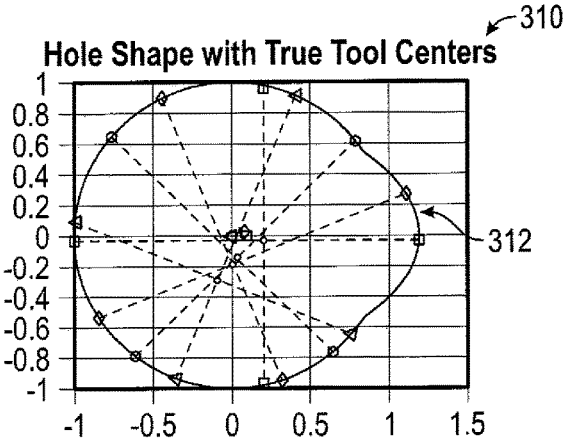
FIG. 3A illustrates an example of a plot depicting a keyseat borehole shape with synthetic caliper measurements.

FIG. 3A illustrates an example of a plot 310 depicting a keyseat borehole shape with synthetic caliper measurements. To compare results of the eccentricity correction shape-fitting algorithm with the traditional circle-fitting algorithm, a synthetic example is used to illustrate a keyseat borehole shape, with an enlarged section (e.g., 312) on one side. It is desirable for the eccentricity-correction algorithm of the subject disclosure to estimate the contour shape of the borehole including the enlarged section 312 as closely as possible given that traditional borehole shape algorithms typically fail to correctly estimate an irregularly shaped borehole. In some aspects, the enlarged section may refer to a non-intact section, and the terms may be used interchangeably without departing from the scope of the subject disclosure. The tool center is randomly generated and four firings are used in the example. Two out of four firings has one transceiver pointing at the enlarged section 312.

Figure 3B:
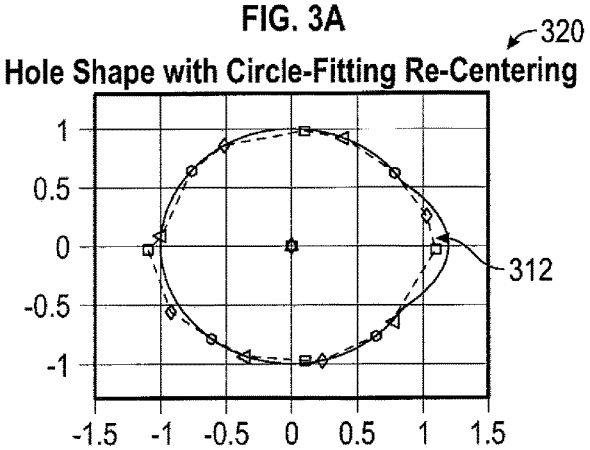
FIG. 3B illustrates an example of a plot depicting a keyseat borehole shape computation with a traditional borehole shape algorithm.

FIG. 3B illustrates an example of a plot 320 depicting a keyseat borehole shape computation with a traditional borehole shape algorithm. The traditional circle-fitting algorithm computed the wrong hole center when one of the points falls in the enlarged area (e.g., 312). In particular, the points do not lie on the contour line of the enlarged section 312. In this respect, the corrected hole shape transfers part of the enlarged feature to the other side of the borehole. This is a typical error caused by the traditional circle-fitting algorithm for the keyseat borehole shape.

Figure 3C:
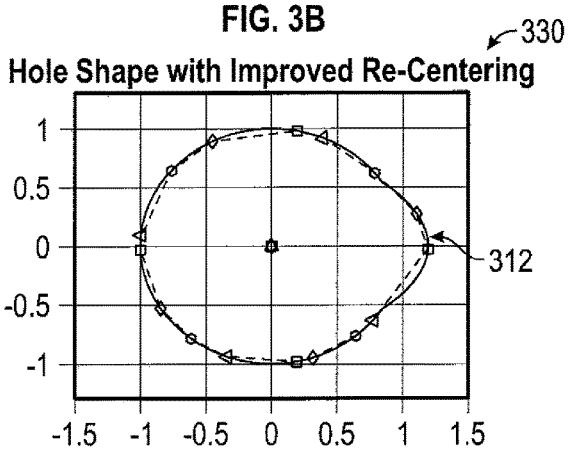
FIG. 3C illustrates an example of a plot depicting a keyseat borehole shape computation with an eccentricity corrected borehole shape algorithm for a given depth interval in accordance with one or more implementations of the subject technology.

FIG. 3C illustrates an example of a plot 330 depicting a keyseat borehole shape computation with the eccentricity correction shape-fitting algorithm for a given depth interval in accordance with one or more implementations of the subject technology. The eccentricity correction shape-fitting algorithm computed the exact hole center with all of the corrected points with correct coordinates. For example, the points on the non-intact section (e.g., 312) of the shape fitted curve (illustrated by the dashed line) align with the non-intact section of the measured borehole (illustrated by the solid line). In this example, the plot 330 includes eccentricity-corrected points based on a hole center having a least number of points outside of the shape fitted curve and least amount of error, and a radius value having a least sum of points outside the shape fitted curve and least sum of errors for all transducer firings in a depth interval.

Figure 4A:
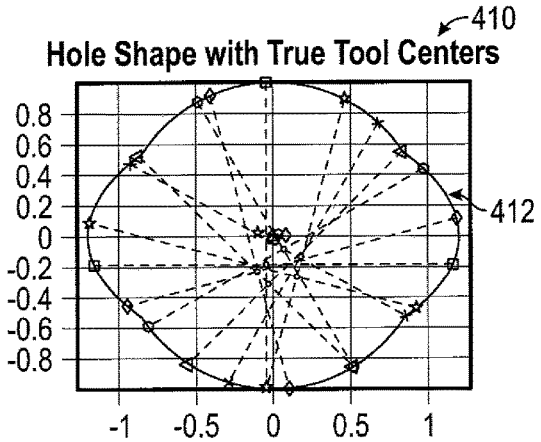
FIG. 4A illustrates an example of a plot depicting a breakout borehole shape with synthetic caliper measurements.

FIG. 4A illustrates an example of a plot 410 depicting a breakout borehole shape with synthetic caliper measurements. The breakout borehole shape depicts the borehole enlarged on two opposite sides. All firings have one or two transceivers facing the enlarged section (e.g., 412). The tool center is randomly generated and six firings are used in the example. To evaluate the robustness of the improved algorithm, 150 firings are generated with random tool centers. Every 6 firings are considered to be in the same depth interval for computation. The rate of error of the algorithm is related to the proportion of non-intact section. This is because the non-intact section does not contain information of the intact borehole.

Figure 4B:
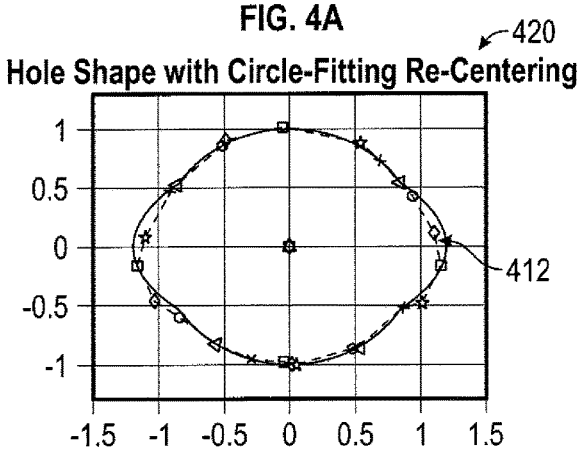
FIG. 4B illustrates an example of a plot depicting a breakout borehole shape computation with a traditional borehole shape algorithm.

FIG. 4B illustrates an example of a plot 420 depicting a breakout borehole shape computation with a traditional borehole shape algorithm. The traditional circle-fitting algorithm generates an inaccurate hole shape on most of the points, especially on the enlarged section 412.

Figure 4C:
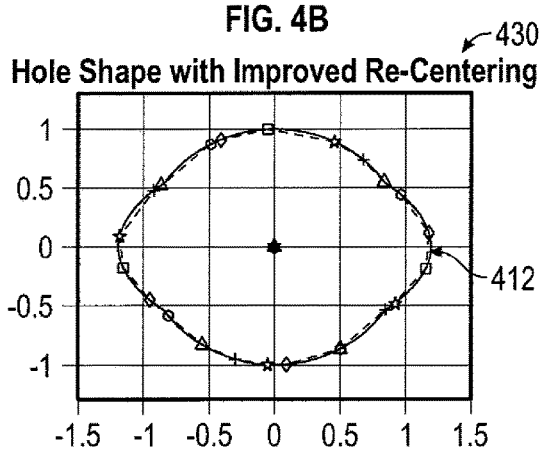
FIG. 4C illustrates an example of a plot depicting a breakout borehole shape computation with an eccentricity corrected borehole shape algorithm for a given depth interval in accordance with one or more implementations of the subject technology.

FIG. 4C illustrates an example of a plot 430 depicting a breakout borehole shape computation with an eccentricity corrected borehole shape algorithm for a given depth interval in accordance with one or more implementations of the subject technology. In contrast to the FIG. 4B, the eccentricity correction shape-fitting algorithm of FIG. 4C computed the exact hole center with all of the corrected points with correct coordinates. For example, the points on the non-intact section (e.g., 412) of the shape fitted curve (illustrated by the dashed line) align with the non-intact section of the measured borehole (illustrated by the solid line). In this example, the plot 430 includes eccentricity-corrected points based on a hole center having a least number of points outside of the shape fitted curve and least amount of error, and a radius value having a least sum of points outside the shape fitted curve and least sum of errors for all transducer firings in a depth interval.

Figure 5A:
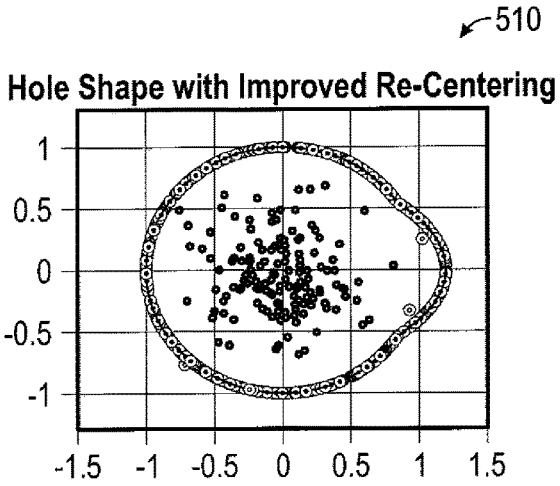
FIG. 5A illustrates an example of a plot depicting a keyseat borehole shape computation with an eccentricity corrected borehole shape algorithm over multiple depth intervals in accordance with one or more implementations of the subject technology.

FIG. 5A illustrates an example of a plot 510 depicting a keyseat borehole shape computation with an eccentricity corrected borehole shape algorithm over multiple depth intervals in accordance with one or more implementations of the subject technology. In FIG. 5A, the keyseat borehole shape depicts one side of the borehole enlarged, where 23% of the borehole section is enlarged. In this example, acquisition data was obtained with 150 firings in 25 depth intervals (e.g., about 6 firings in a depth interval). In FIG. 5A, two firings out of the 150 firings resulted in incorrect coordinates, where the corresponding points were located outside of the keyseat borehole shape. In some aspects, the number of firings deployed may be programmed according to a target resolution of the borehole shape. In this respect, the higher the number of firings, the higher the number of data points for estimating the contour shape of the borehole circumference.

Figure 5B:
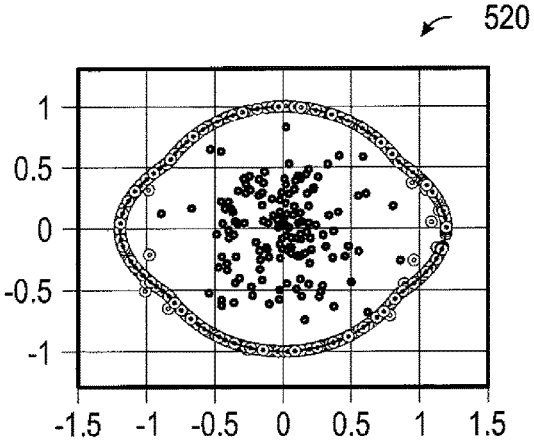
FIG. 5B illustrates an example of a plot depicting a breakout borehole shape computation with an eccentricity corrected borehole shape algorithm over multiple depth intervals in accordance with one or more implementations of the subject technology.

FIG. 5B illustrates an example of a plot 520 depicting a breakout borehole shape computation with an eccentricity corrected borehole shape algorithm over multiple depth intervals in accordance with one or more implementations of the subject technology. In FIG. 5B, the breakout borehole shape depicts two opposite sides of the borehole enlarged, where 46% of the borehole section is enlarged. In this example, acquisition data was obtained with 150 firings in 25 depth intervals (e.g., about 6 firings in a depth interval).

In FIG. 5B, seven firings out of the 150 firings resulted in incorrect coordinates, where the corresponding points were located outside of the breakout borehole shape. Since the eccentricity corrected borehole shape algorithm produces a high percentage of correct results for borehole shape computation with a significant proportion of enlarged area, its robustness is proven and incorrect results can be picked out as outliers.

Figure 6A:
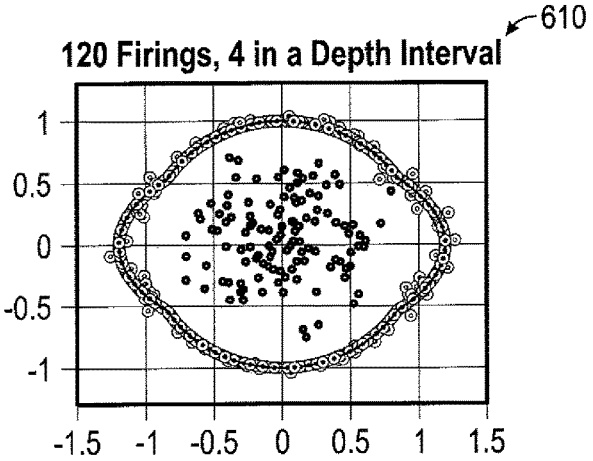
FIGS. 6A to 6C illustrate examples of plots depicting a breakout borehole shape computation with an eccentricity corrected borehole shape algorithm for different number of firings in a given depth interval in accordance with one or more implementations of the subject technology.
Figure 6B:
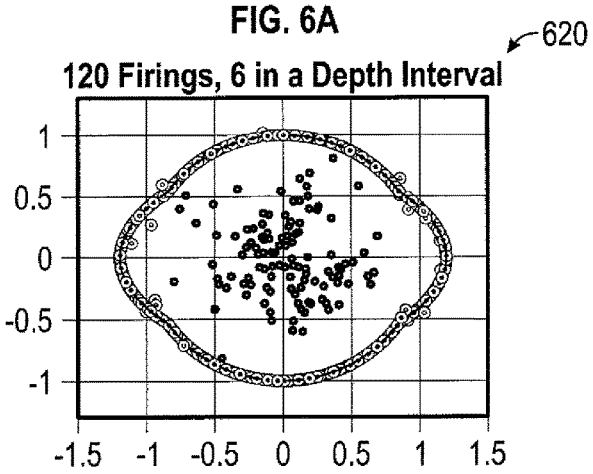
Figure 6C:
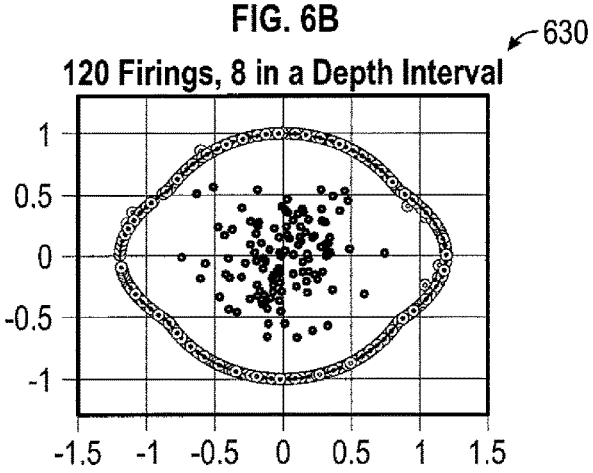

FIGS. 6A to 6C illustrate examples of plots depicting a breakout borehole shape computation with an eccentricity corrected borehole shape algorithm for different number of firings in a given depth interval in accordance with one or more implementations of the subject technology. For cases with a significant portion of non-intact borehole, stacking more number of firings in the same depth interval helps to reduce the error rate. FIGS. 6A-6C show a breakout example with 120 firings, with 4, 6 and 8 firings in a depth interval, respectively. The number firings with incorrect coordinates is 19, 7 and 4, respectively.

In FIG. 6A, the acquisition logic 160 acquired field measurements from 30 depth intervals, where 4 firings were deployed per depth interval for a total of 120 transducer firings with 19 incorrect coordinates detected. In FIG. 6B, the acquisition logic 160 acquired field measurements from 20 depth intervals, where 6 firings were deployed per depth interval for a total of 120 transducer firings with 7 incorrect coordinates detected. In FIG. 6C, the acquisition logic 160 acquired field measurements from 15 depth intervals, where 8 firings were deployed per depth interval for a total of 120 transducer firings with 4 incorrect coordinates detected.

Figure 7A:
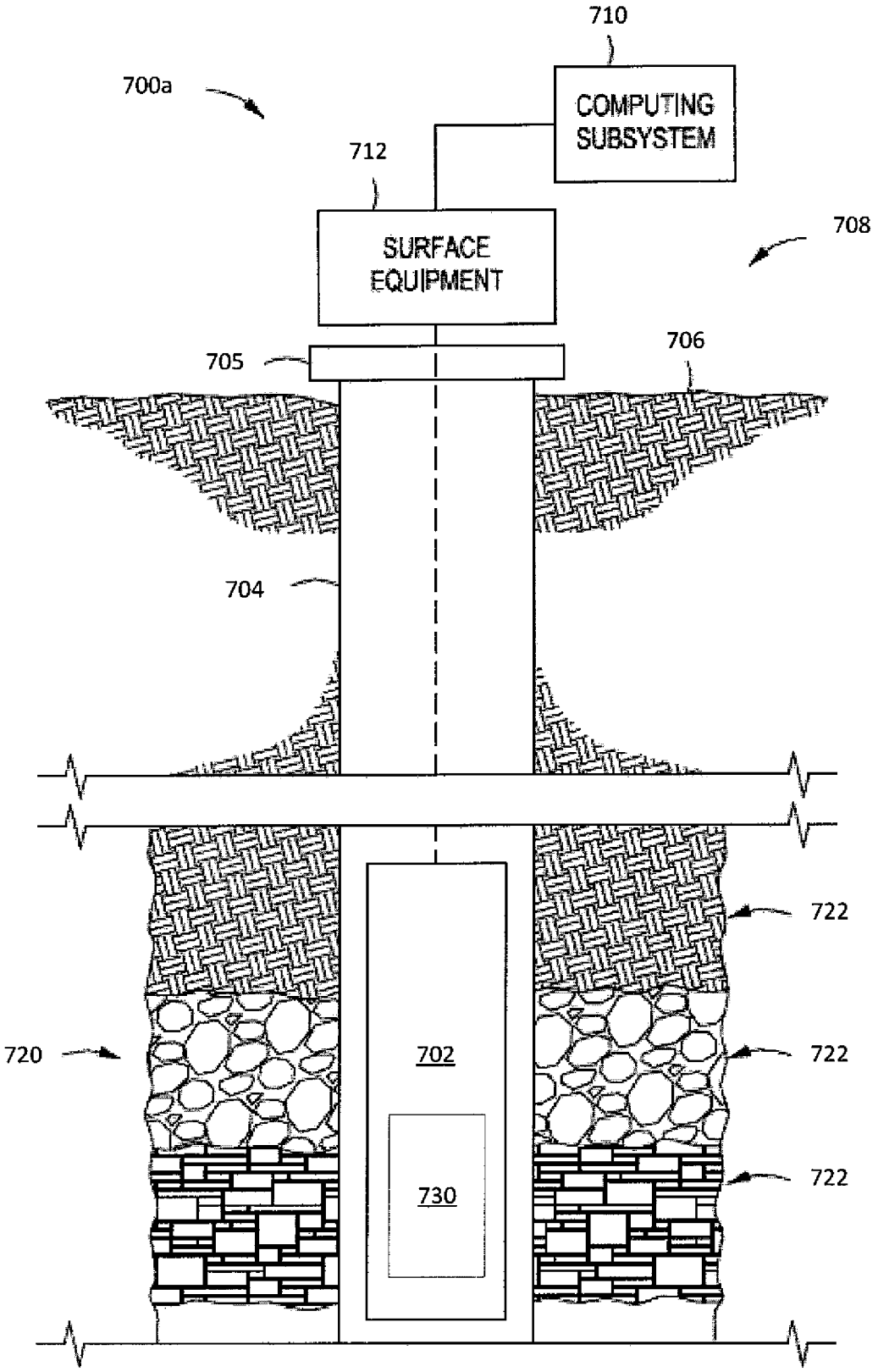
FIG. 7A illustrates a schematic view of a logging operation deployed in and around a well system in accordance with one or more implementations of the subject technology.

FIG. 7A depicts a schematic view of a logging operation deployed in and around a well system 700*a* in accordance with one or more implementations. The well system 700*a* includes a logging system 708 and a subterranean region 720 beneath the ground surface 706. The well system 700*a* can also include additional or different features that are not shown in FIG. 7A. For example, the well system 700*a* can include additional drilling system components, wireline logging system components, or other components.

The subterranean region 720 includes all or part of one or more subterranean formations or zones. The subterranean region 720 shown in FIG. 7A, for example, includes multiple subsurface layers 722. The subsurface layers 722 can include sedimentary layers, rock layers, sand layers, or any combination thereof and other types of subsurface layers. One or more of the subsurface layers can contain fluids, such as brine, oil, gas, or combinations thereof. A borehole 704 penetrates through the subsurface layers 722. Although the borehole 704 shown in FIG. 7A is a vertical borehole, the logging system 708 can also be implemented in other borehole orientations. For example, the logging system 708 may be adapted for horizontal boreholes, slant boreholes, curved boreholes, vertical boreholes, or any combination thereof.

The logging system 708 also includes a logging tool 702, surface equipment 712, and a computing subsystem 710. In the shown in FIG. 7A, the logging tool 702 is a downhole logging tool that operates while disposed in the borehole 704. The surface equipment 712 shown in FIG. 7A operates at or above the surface 706, for example, near the well head 705, to control the logging tool 702 and possibly other downhole equipment or other components of the well system 700*a*. The computing subsystem 710 receives and analyzes logging data from the logging tool 702. A logging system can include additional or different features, and the features of an logging system can be arranged and operated as represented in FIG. 7A or in another manner.

All or part of the computing subsystem 710 can be implemented as a component of, or integrated with one or more components of, the surface equipment 712, the logging tool 702, or both. For example, the computing subsystem 710 can be implemented as one or more computing structures separate from but communicative with the surface equipment 712 and the logging tool 702.

The computing subsystem 710 can be embedded in the logging tool 702 (not shown), and the computing subsystem 710 and the logging tool 702 operate concurrently while disposed in the borehole 704. For example, although the computing subsystem 710 is shown above the surface 706 in FIG. 7A, all or part of the computing subsystem 710 may reside below the surface 706, for example, at or near the location of the logging tool 702.

The well system 700*a* includes communication or telemetry equipment that allows communication among the computing subsystem 710, the logging tool 702, and other components of the logging system 708. For example, each of the components of the logging system 708 can include one or more transceivers or similar apparatus for wired or wireless data communication among the various components. The logging system 708 can include, but is not limited to, one or more systems and/or apparatus for wireline telemetry, wired pipe telemetry, mud pulse telemetry, acoustic telemetry, electromagnetic telemetry, or any combination of these and other types of telemetry. In some implementations, the logging tool 702 receives commands, status signals, or other types of information from the computing subsystem 710 or another source. The computing subsystem 710 can also receive logging data, status signals, or other types of information from the logging tool 702 or another source.

Logging operations are performed in connection with various types of downhole operations at various stages in the lifetime of a well system and therefore structural attributes and components of the surface equipment 712 and logging tool 702 are adapted for various types of logging operations. For example, logging may be performed during drilling operations, during wireline logging operations, or in other contexts. As such, the surface equipment 712 and the logging tool 702 can include or operate in connection with drilling equipment, wireline logging equipment, or other equipment for other types of operations.

In some implementations of FIG. 7 A, the logging tool 702 is provided with a caliper device 730. The caliper device 730 may include a set of distance sensors that measure borehole standoff data or radial distance. The caliper device 730 is configured to perform two or more sets of standoff measurements per acquisition. Acquisitions are performed once per capture interval. Each standoff measurement set includes borehole standoff data that corresponds to standoff measurements obtained substantially simultaneously by the set of distance sensors. The borehole standoff data in turn includes standoff values associated with individual acquisitions. A capture interval can occur periodically, such as at predetermined time intervals, at predetermined length intervals as the caliper 730 is advanced along a length of the borehole 704, and/or in response to a control signal. The control signal can be triggered by, for example, user activation, a sensor output exceeding a predetermined threshold value, or a processing determination, such as by the computing subsystem 710.

Examples of calipers that may be used include ultrasound transducers, electromagnetic transducers, mechanical arms and/or fingers, such as with pressure sensors, etc. An example suitable caliper device 730 can include a cylindrical body (not shown) and the set of distance sensors disposed on the body. The set of distance sensors can include four ultrasonic transducers (not shown) that are located at about the same distance along the length of the body of the caliper device 730 and evenly spaced about the circumference of the body.

The set of distance sensors perform standoff measurements by emitting an ultrasonic signal directed at an angle normal to the body of the caliper device 730 towards an inner surface of a borehole wall surrounding the borehole 704. Reflected ultrasonic signals are detected by the set of distance sensors. The time interval between the emission and detection is measured and output as borehole standoff data that can be used to determine the standoff distance between the set of distance sensors and the borehole wall. The set of distance sensors can perform standoff measurements substantially simultaneously as the logging tool 702 moves within the borehole 704 in a rotational, non-rotational, or translational motion.

In some implementations, standoff data acquisition is performed over the course of a single logging tool rotation. During the acquisition, multiple standoff measurement sets are acquired. As explained above, each standoff measurement set includes a standoff measurement performed by all of the set of distance sensors simultaneously. In an example, four measurement sets are acquired by the set of distance sensors simultaneously during an acquisition. For example, the caliper device 730 may include four (4) distance sensors performing four measurement sets per acquisition, in which the set of distance sensors would generate sixteen (16) standoff measurements per acquisition.

The eccentricity-corrected fitted shape may then be used as an estimation of a shape of the borehole 704 at the location where the data points were acquired. The shape of the borehole 704 at different locations along the borehole 704 can thereafter be used to determine and/or monitor characteristics of the borehole 704, such as changes in the shape of the borehole 704, stability of the borehole 704, or volume of the borehole 704.

The determining and/or monitoring can be performed in real time during a drilling operation. This allows the drilling operation to be controlled in real time to cause or prevent changes in the borehole shape as needed in response to the estimated shape of the borehole 704. For example, accurate borehole size and shape can be used to perform environmental correction of LWD sensors, provide real-time assessment of borehole stability, and calculate cement volume for filling the borehole.

The determining and/or monitoring can also be performed after a drilling operation based on the estimated shape of the borehole 704 along the length of the borehole 704. Determinations can be made about available and/or feasible usage and/or treatment of the borehole 704 based on the estimated shape of the borehole 704 along its length. For example, the estimated shape of the borehole 704 along its length can be used to determine a volume of a material to insert in the borehole 704, e.g., to fill and/or reinforce the borehole 704. The estimated shape of the borehole 704 along the length of the borehole 704 can be used to generate a model of the borehole 704, such as for making predictions, e.g., of the borehole's stability over time, and/or determining the need for an intervention, such as changing a characteristic of a drilling fluid, e.g., mud weight or mud type.

Figure 7B:
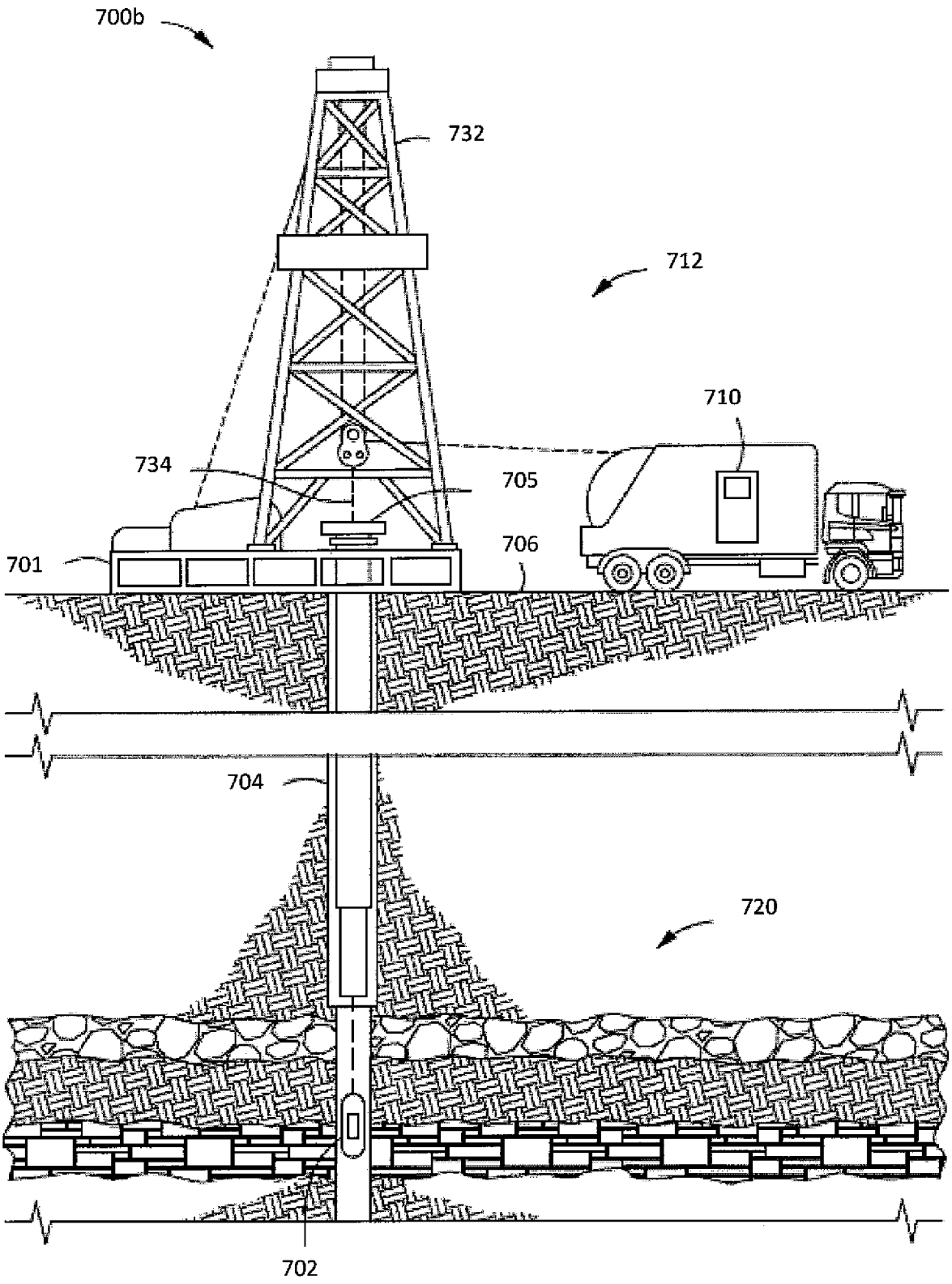
FIG. 7B illustrates a schematic view of a wireline logging operation deployed in and around a well system in accordance with one or more implementations of the subject technology.

FIG. 7B depicts a schematic view of a wireline logging operation deployed in and around a well system 700*b* in accordance with one or more implementations. The well system 700*b* includes the logging tool 702 in a wireline logging environment. The surface equipment 712 includes, but is not limited to, a platform 701 disposed above the surface 706 equipped with a derrick 732 that supports a wireline cable 734 extending into the borehole 704. Wireline logging operations are performed, for example, after a drill string is removed from the borehole 704, to allow the wireline logging tool 702 to be lowered by wireline or logging cable into the borehole 704.

Figure 7C:
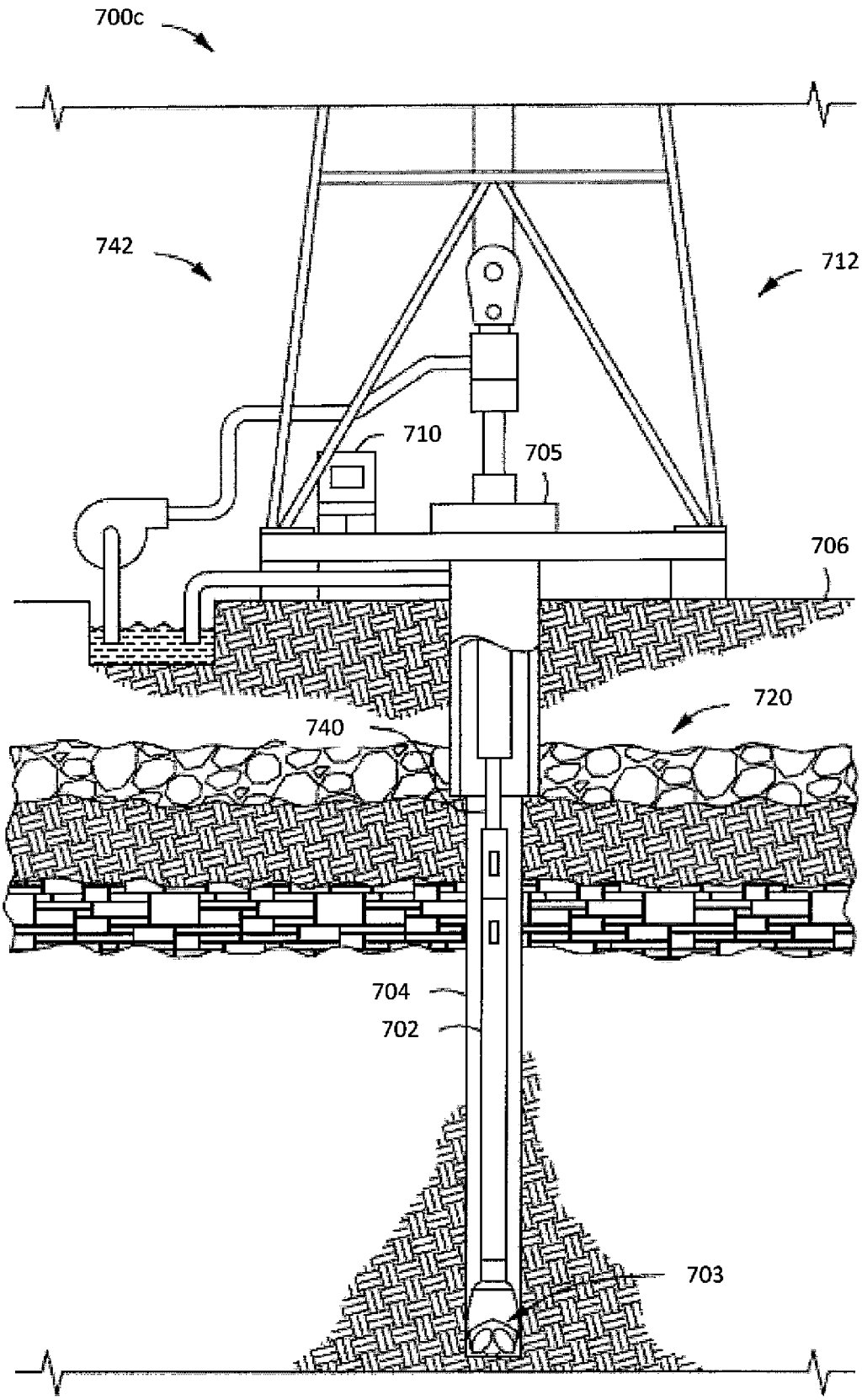
FIG. 7C illustrates a schematic view of a well system that includes the logging tool in a logging while drilling (LWD) environment in accordance with one or more implementations of the subject technology.

FIG. 7C depicts a schematic view of a well system 700*c* that includes the logging tool 702 in a logging while drilling (LWD) environment in accordance with one or more implementations. logging operations is performed during drilling operations. Drilling is performed using a string of drill pipes connected together to form a drill string 740 that is lowered through a rotary table into the borehole 704. A drilling rig 742 at the surface 706 supports the drill string 740, as the drill string 740 is operated to drill a borehole penetrating the subterranean region 720. The drill string 740 can include, for example, but is not limited to, a kelly, a drill pipe, a bottom hole assembly, and other components. The bottomhole assembly on the drill string can include drill collars, drill bits, the logging tool 702, and other components. Exemplary logging tools can be or include, but are not limited to, measuring while drilling (MWD) tools and LWD tools.

The logging tool 702 includes a tool for acquiring measurements from the subterranean region 720. As shown, for example, in FIG. 7B, the logging tool 702 is suspended in the borehole 704 by a coiled tubing, wireline cable, or another structure or conveyance that connects the tool to a surface control unit or other components of the surface equipment 712.

The logging tool 702 is lowered to the bottom of a region of interest and subsequently pulled upward (e.g., at a substantially constant speed) through the region of interest. As shown, for example, in FIG. 7C, the logging tool 702 is deployed in the borehole 704 on jointed drill pipe, hard wired drill pipe, or other deployment hardware. In other example implementations, the logging tool 702 collects data during drilling operations as it moves downward through the region of interest. The logging tool 702 may also collect data while the drill string 740 is moving, for example, while the logging tool 702 is being tripped in or tripped out of the borehole 704.

The logging tool 702 may also collect data at discrete logging points in the borehole 704. For example, the logging tool 702 moves upward or downward incrementally to each logging point at a series of depths in the borehole 704. At each logging point, instruments in the logging tool 702 perform measurements on the subterranean region 720. The logging tool 702 also obtains measurements while the logging tool 702 is moving (e.g., being raised or lowered). The measurement data is communicated to the computing subsystem 710 for storage, processing, and analysis. Such data may be gathered and analyzed during drilling operations (e.g., LWD operations), during wireline logging operations, other conveyance operations, or during other types of activities.

The computing subsystem 710 receives and analyzes the measurement data from the logging tool 702 to detect properties of various subsurface layers 722. For example, the computing subsystem 710 can identify the density, material content, and/or other properties of the subsurface layers 722 based on the measurements acquired by the logging tool 702 in the borehole 704.

Figure 8:
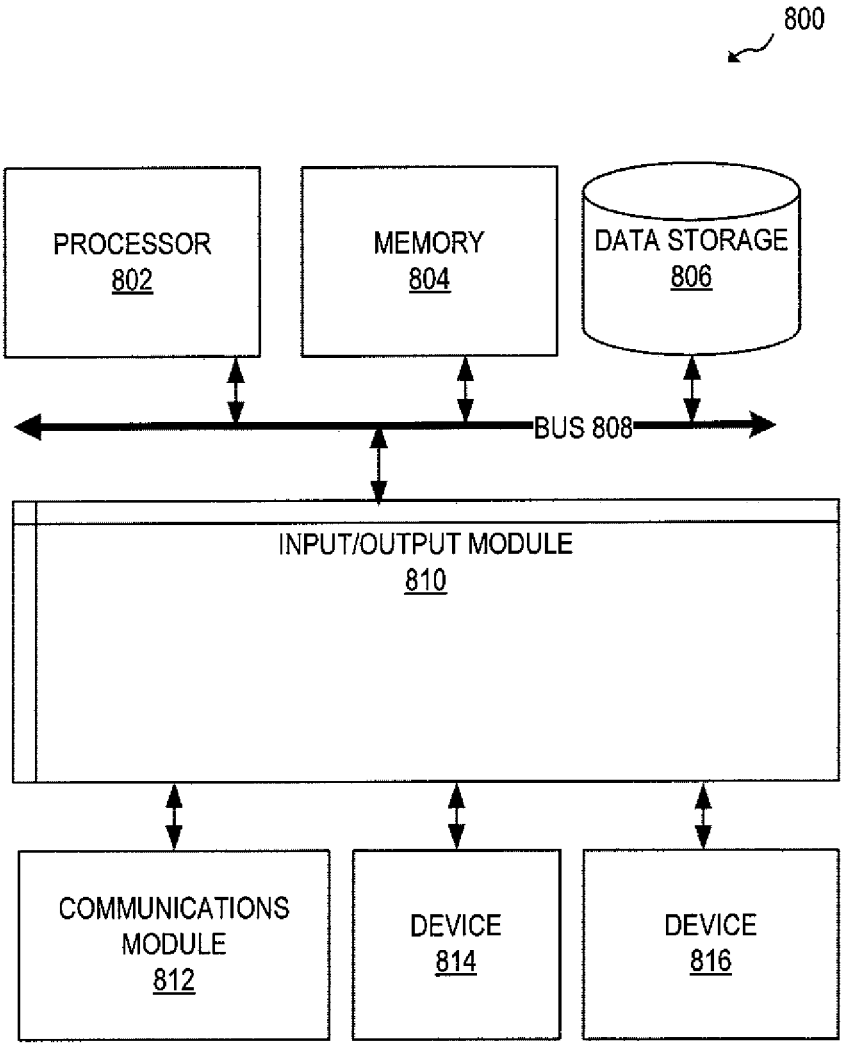
FIG. 8 is a block diagram illustrating an example computer system with which the computing subsystem of FIG. 7A can be implemented.

FIG. 8 is a block diagram illustrating an exemplary computer system 800 with which the computing subsystem 710 of FIG. 7A can be implemented. In certain aspects, the computer system 800 may be implemented using hardware or a combination of software and hardware, either in a dedicated server, integrated into another entity, or distributed across multiple entities.

Computer system 800 (e.g., computing subsystem 710) includes a bus 808 or other communication mechanism for communicating information, and a processor 802 coupled with bus 808 for processing information. By way of example, the computer system 800 may be implemented with one or more processors 802. Processor 802 may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information.

Computer system 800 can include, in addition to hardware, code that creates an execution environment for the computer program in question, e.g., code that constitutes processor firmware, a protocol stack, a database management system, an operating system, or a combination of one or more of them stored in an included memory 804, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device, coupled to bus 808 for storing information and instructions to be executed by processor 802. The processor 802 and the memory 804 can be supplemented by, or incorporated in, special purpose logic circuitry.

The instructions may be stored in the memory 804 and implemented in one or more computer program products, i.e., one or more modules of computer program instructions encoded on a computer readable medium for execution by, or to control the operation of, the computer system 800, and according to any method well known to those of skill in the art, including, but not limited to, computer languages such as data-oriented languages (e.g., SQL, dBase), system languages (e.g., C, Objective-C, C++, Assembly), architectural languages (e.g., Java, .NET), and application languages (e.g., PHP, Ruby, Perl, Python). Instructions may also be implemented in computer languages such as array languages, aspect-oriented languages, assembly languages, authoring languages, command line interface languages, compiled languages, concurrent languages, curly-bracket languages, dataflow languages, data-structured languages, declarative languages, esoteric languages, extension languages, fourth-generation languages, functional languages, interactive mode languages, interpreted languages, iterative languages, list-based languages, little languages, logic-based languages, machine languages, macro languages, metaprogramming languages, multiparadigm languages, numerical analysis, non-English-based languages, object-oriented class-based languages, object-oriented prototype-based languages, off-side rule languages, procedural languages, reflective languages, rule-based languages, scripting languages, stack-based languages, synchronous languages, syntax handling languages, visual languages, wirth languages, and xml-based languages. Memory 804 may also be used for storing temporary variable or other intermediate information during execution of instructions to be executed by processor 802.

A computer program as discussed herein does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, subprograms, or portions of code). A computer program can be deployed to be executed on one computer or on multiple computers that are located at one site or distributed across multiple sites and interconnected by a communication network. The processes and logic flows described in this specification can be performed by one or more programmable processors executing one or more computer programs to perform functions by operating on input data and generating output.

Computer system 800 further includes a data storage device 806 such as a magnetic disk or optical disk, coupled to bus 808 for storing information and instructions. Computer system 800 may be coupled via input/output module 810 to various devices. The input/output module 810 can be any input/output module. Exemplary input/output modules 810 include data ports such as USB ports. The input/output module 810 is configured to connect to a communications module 812. Exemplary communications modules 812 include networking interface cards, such as Ethernet cards and modems. In certain aspects, the input/output module 810 is configured to connect to a plurality of devices, such as an input device 814 and/or an output device 816. Exemplary input devices 814 include a keyboard and a pointing device, e.g., a mouse or a trackball, by which a user can provide input to the computer system 800. Other kinds of input devices 814 can be used to provide for interaction with a user as well, such as a tactile input device, visual input device, audio input device, or brain-computer interface device. For example, feedback provided to the user can be any form of sensory feedback, e.g., visual feedback, auditory feedback, or tactile feedback, and input from the user can be received in any form, including acoustic, speech, tactile, or brain wave input. Exemplary output devices 816 include display devices such as a LCD (liquid crystal display) monitor, for displaying information to the user, or diagnostic devices such as an oscilloscope.

According to one aspect of the present disclosure, the computing subsystem 110 can be implemented using a computer system 800 in response to processor 802 executing one or more sequences of one or more instructions contained in memory 804. Such instructions may be read into memory 804 from another machine-readable medium, such as data storage device 806. Execution of the sequences of instructions contained in the main memory 804 causes processor 802 to perform the process steps described herein. One or more processors in a multi-processing arrangement may also be employed to execute the sequences of instructions contained in the memory 804. In alternative aspects, hard-wired circuitry may be used in place of or in combination with software instructions to implement various aspects of the present disclosure. Thus, aspects of the present disclosure are not limited to any specific combination of hardware circuitry and software.

Various aspects of the subject matter described in this specification can be implemented in a computing system that includes a back end component, e.g., such as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. The communication network can include, for example, any one or more of a LAN, a WAN, the Internet, and the like. Further, the communication network can include, but is not limited to, for example, any one or more of the following network topologies, including a bus network, a star network, a ring network, a mesh network, a star-bus network, tree or hierarchical network, or the like. The communications modules can be, for example, modems or Ethernet cards.

Computer system 800 can include clients and servers. A client and server are generally remote from each other and typically interact through a communication network. The relationship of client and server arises by virtue of computer programs running on the respective computers and having a client-server relationship to each other. Computer system 800 can be, for example, and without limitation, a desktop computer, laptop computer, or tablet computer. Computer system 800 can also be embedded in another device, for example, and without limitation, a mobile telephone such as a smartphone.

The term "machine-readable storage medium" or "computer readable medium" as used herein refers to any medium or media that participates in providing instructions to processor 802 for execution. Such a medium may take many forms, including, but not limited to, non-volatile media, volatile media, and transmission media. Non-volatile media include, for example, optical or magnetic disks, such as data storage device 806. Volatile media include dynamic memory, such as memory 804. Transmission media include coaxial cables, copper wire, and fiber optics, including the wires that comprise bus 808. Common forms of machine-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH EPROM, any other memory chip or cartridge, or any other medium from which a computer can read. The machine-readable storage medium can be a machine-readable storage device, a machine-readable storage substrate, a memory device, a composition of matter effecting a machine-readable propagated signal, or a combination of one or more of them.

Figure 9:
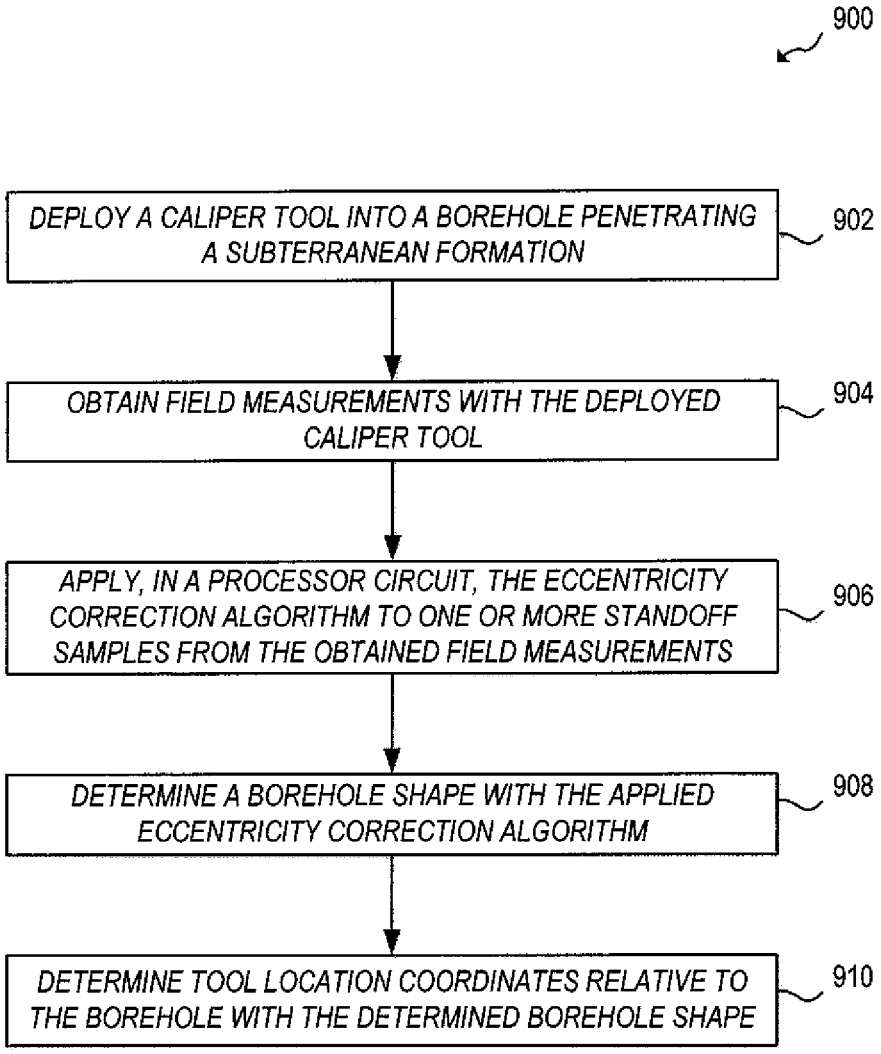
FIG. 9 illustrates a flowchart of a process for a downhole operation using a borehole shape prediction based on an eccentricity correction algorithm in accordance with one or more implementations of the subject technology.

FIG. 9 illustrates a flowchart of a process 900 for a downhole operation using a borehole shape prediction based on an eccentricity correction algorithm in accordance with one or more implementations of the subject technology. Further for explanatory purposes, the blocks of the sequential process 900 are described herein as occurring in serial, or linearly. However, multiple blocks of the process 900 may occur in parallel. In addition, the blocks of the process 900 need not be performed in the order shown and/or one or more of the blocks of the process 900 need not be performed.

The process 900 starts at step 902, where a caliper tool is deployed into a borehole penetrating a subterranean formation. Next, at step 904, field measurements are obtained with the deployed caliper tool. Subsequently, at step 906, an eccentricity correction algorithm is applied, in a processing circuit, to one or more standoff samples from the obtained field measurements. In some aspects, the eccentricity correction algorithm produces a shape fitted curve that represents a measured borehole with a least number of points outside of the shape fitted curve and a least amount of error. Subsequently, at step 908, a borehole shape is determined with the applied eccentricity correction algorithm. Next, at step 910, tool location coordinates relative to the borehole are determined with the determined borehole shape.

Various examples of aspects of the disclosure are described below. These are provided as examples, and do not limit the subject technology.

Clause A. A method includes deploying a caliper tool into a borehole penetrating a subterranean formation; acquiring field measurements with the deployed caliper tool; applying, in a processor circuit, an eccentricity correction algorithm to one or more standoff samples from the obtained field measurements, wherein the eccentricity correction algorithm produces a shape fitted curve that represents a measured borehole with a least number of points outside of the shape fitted curve and a least amount of error; determining eccentricity-corrected borehole coordinates with the applied eccentricity correction algorithm; determining a borehole shape from the eccentricity-corrected borehole coordinates; and determining tool location coordinates relative to the borehole with the determined borehole shape.

Clause B. A system includes a caliper tool; and a caliper measurement device operably coupled to the caliper tool and having a memory and a processor, wherein the memory comprises commands which, when executed by the processor, cause the caliper measurement device to acquire field measurements from the caliper tool; apply an eccentricity correction algorithm to one or more standoff samples from the obtained field measurements, wherein the eccentricity correction algorithm produces a shape fitted curve that represents a measured borehole with a least number of points outside of the shape fitted curve and a least amount of error; determine eccentricity-corrected borehole coordinates with the applied eccentricity correction algorithm; determine a borehole shape from the eccentricity-corrected borehole coordinates; and determine tool location coordinates relative to the borehole with the determined borehole shape.

Clause C. A non-transitory computer-readable medium storing instructions which, when executed by a processor, cause a computer to acquire field measurements from a caliper tool deployed into a borehole penetrating a subterranean formation; apply an eccentricity correction algorithm to one or more standoff samples from the obtained field measurements, wherein the eccentricity correction algorithm produces a shape fitted curve that represents the borehole with a least number of points outside of the shape fitted curve and a least amount of error; determine eccentricity-corrected borehole coordinates with the applied eccentricity correction algorithm; determine a borehole shape from the eccentricity-corrected borehole coordinates; and determine tool location coordinates relative to the borehole with the determined borehole shape.

In one or more aspects, examples of clauses are described below.

A method comprising one or more methods, operations or portions thereof described herein.

An apparatus comprising one or more memories and one or more processors (e.g., 800), the one or more processors configured to cause performing one or more methods, operations or portions thereof described herein.

An apparatus comprising one or more memories (e.g., 804, one or more internal, external or remote memories, or one or more registers) and one or more processors (e.g., 802) coupled to the one or more memories, the one or more processors configured to cause the apparatus to perform one or more methods, operations or portions thereof described herein.

An apparatus comprising means (e.g., 800) adapted for performing one or more methods, operations or portions thereof described herein.

A processor (e.g., 802) comprising modules for carrying out one or more methods, operations or portions thereof described herein.

A hardware apparatus comprising circuits (e.g., 800) configured to perform one or more methods, operations or portions thereof described herein.

An apparatus comprising means (e.g., 800) adapted for performing one or more methods, operations or portions thereof described herein.

An apparatus comprising components (e.g., 800) operable to carry out one or more methods, operations or portions thereof described herein.

A computer-readable storage medium (e.g., 804, one or more internal, external or remote memories, or one or more registers) comprising instructions stored therein, the instructions comprising code for performing one or more methods or operations described herein.

A computer-readable storage medium (e.g., 804, one or more internal, external or remote memories, or one or more registers) storing instructions that, when executed by one or more processors, cause one or more processors to perform one or more methods, operations or portions thereof described herein.

In one aspect, a method may be an operation, an instruction, or a function and vice versa. In one aspect, a clause or a claim may be amended to include some or all of the words (e.g., instructions, operations, functions, or components) recited in other one or more clauses, one or more words, one or more sentences, one or more phrases, one or more paragraphs, and/or one or more claims.

To illustrate the interchangeability of hardware and software, items such as the various illustrative blocks, modules, components, methods, operations, instructions, and algorithms have been described generally in terms of their functionality. Whether such functionality is implemented as hardware, software or a combination of hardware and software depends upon the particular application and design constraints imposed on the overall system. Skilled artisans may implement the described functionality in varying ways for each particular application.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the subject technology. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

Therefore, the subject technology is well adapted to attain the ends and advantages mentioned as well as those that are inherent therein. The particular embodiments disclosed above are illustrative only, as the subject technology may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the subject technology. The subject technology illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method, comprising:

deploying a caliper tool into a borehole penetrating a subterranean formation; acquiring field measurements with the deployed caliper tool;

applying, in a processor circuit, an eccentricity correction algorithm to one or more standoff samples from the obtained field measurements, wherein the eccentricity correction algorithm produces a shape fitted curve that represents a measured borehole with a least number of points outside of the shape fitted curve and a least amount of error;

determining eccentricity-corrected borehole coordinates with the applied eccentricity correction algorithm;

determining a borehole shape from the eccentricity-corrected borehole coordinates; and determining tool location coordinates relative to the borehole with the determined borehole shape, wherein applying the eccentricity correction algorithm comprises:

determining a number of points on an intact section of the shape fitted curve and an non-intact section of the shape fitted curve for a predetermined number of transducer firings;

determining a number of errors of the shape fitted curve for the predetermined number of transducer firings;

determining a hole center of the shape fitted curve based on the determined number of points on the shape fitted curve and the determined number of errors of the shape fitted curve; and determining a hole radius of the shape fitted curve based on a minimized sum of the determined number of points and a minimized sum of the determined number of errors for the predetermined number of transducer firings in a depth interval.

2. The method of claim 1, wherein determining the number of errors of the shape fitted curve comprises:

reducing a difference between a square of a measured radius of the borehole and a square of an estimated radius of the shape fitted curve for each transducer firing.

3. The method of claim 1, wherein acquiring the field measurements comprises:

acquiring a standoff measurement for each transducer firing in a depth interval; and acquiring an angle of firing measurement for each transducer firing in the depth interval.

4. The method of claim 3, further comprising:

determining uncorrected coordinates of a plurality of points of a measured borehole for each transducer firing using the standoff measurement and the angle of firing measurement.

5. The method of claim 4, further comprising:

applying a shape fitting algorithm for every predetermined number of points of the plurality of points to acquire a listing of radius values corresponding to an intact section of the measured borehole.

6. The method of claim 5, further comprising:

applying a shape fitting algorithm to all combinations of a predetermined number of points with a radius value of the listing of radius values to compute a plurality of hole centers.

7. The method of claim 6, further comprising:

selecting one of the plurality of hole centers associated with a least number of points out of the shape fitted curve and a least amount of error for each transducer firing.

8. The method of claim 7, further comprising:

selecting a radius value of the listing of radius values associated with the selected hole center with a least sum of number of points out of the shape fitted curve for all transducer firings and a least sum of errors for all transducer firings.

9. The method of claim 8, further comprising:

determining coordinates of eccentricity-corrected points on a representation of the measured borehole using the selected radius value and the selected hole center.

10. The method of claim 9, further comprising:

performing interpolation from the eccentricity-corrected points to compute a representation of the borehole shape for the measured borehole.

11. A system, comprising: a caliper tool; and a caliper measurement device operably coupled to the caliper tool and having a memory and a processor, wherein the memory comprises commands which, when executed by the processor, cause the caliper measurement device to:

acquire field measurements from the caliper tool;

apply an eccentricity correction algorithm to one or more standoff samples from the obtained field measurements, wherein the eccentricity correction algorithm produces a shape fitted curve that represents a measured borehole with a least number of points outside of the shape fitted curve and a least amount of error;

determine eccentricity-corrected borehole coordinates with the applied eccentricity correction algorithm;

determine a borehole shape from the eccentricity-corrected borehole coordinates; and determine tool location coordinates relative to the borehole with the determined borehole shape, wherein, when applying the eccentricity correction algorithm, the commands which, when executed by the processor, further cause the caliper measurement device to:

determining a number of points out of the shape fitted curve for each of a plurality of transducer firings;

determining a number of errors of the shape fitted curve for each of the plurality of transducer firings;

determine a hole center of the shape fitted curve with a least number of points out of the shape fitted curve and a least number of errors; and determine a hole radius of the shape fitted curve with a minimized sum of the number of points out of the shape fitted curve for all transducer firings and a minimized sum of the number of errors for all transducer firings.

12. The system of claim 11, wherein, when determining the number of points out of the shape fitted curve, the commands which, when executed by the processor, further cause the caliper measurement device to:

determine a first magnitude measurement of a transducer firing along a first axis, for each of a plurality of transducers associated with one of the plurality of transducer firings;

determine a first hole center estimation of the shape fitted curve along the first axis for each of the plurality of transducers associated with the one of the plurality of transducer firings;

determine a first difference between the first magnitude measurement and the first hole center estimation;

determine a second magnitude measurement of a transducer firing, along a second axis orthogonal to the first axis, for each of the plurality of transducers associated with the one of the plurality of transducer firings;

determine a second hole center estimation of the shape fitted curve along the second axis for each of the plurality of transducers associated with the one of the plurality of transducer firings;

determine a second difference between the second magnitude measurement and the second hole center estimation;

determine a sum of a square of the first difference and a square of the second difference;

determine a third difference between the determined sum and a square of a hole radius of an intact section of the shape fitted curve to produce a first solution vector; and apply an L0-norm optimization algorithm to the first solution vector for each of the plurality of transducer firings to maximize the number of points on the shape fitted curve, wherein the determined number of points corresponds to the maximized number of data points on the shape fitted curve.

13. The system of claim 11, wherein, when determining the number of errors for each transducer firing, the commands which, when executed by the processor, further cause the caliper measurement device to:

determine a first magnitude measurement of a transducer, firing along a first axis, for each of a plurality of transducers associated with one of the plurality of transducer firings;

determine a first hole center estimation of the shape fitted curve along the first axis for each of the plurality of transducers associated with the one of the plurality of transducer firings;

determine a first difference between the first magnitude measurement and the first hole center estimation;

determine a second magnitude measurement of a transducer firing along a second axis orthogonal to the first axis for each of the plurality of transducers associated with the one of the plurality of transducer firings;

determine a second hole center estimation of the shape fitted curve along the second axis for each of the plurality of transducers associated with the one of the plurality of transducer firings;

determine a second difference between the second magnitude measurement and the second hole center estimation;

determine a sum of a square of the first difference and a square of the second difference;

determine a third difference between the determined sum and a square of a hole radius of an intact section of the shape fitted curve to produce a second solution vector; and apply a square to an absolute value of the second solution vector for each of the plurality of transducer firings to minimize the number of errors on the shape fitted curve, wherein the determined number of errors corresponds to the minimized number of errors on the shape fitted curve.

14. The system of claim 11, wherein the caliper tool comprises a plurality of acoustic transducers.

15. The system of claim 14, wherein the caliper measurement device is configured to:

deploy the plurality of transducer firings at different angles of firing with the plurality of acoustic transducers.

16. A non-transitory computer-readable medium storing instructions which, when executed by a processor, cause a computer to:

acquire field measurements from a caliper tool deployed into a borehole penetrating a subterranean formation;

apply an eccentricity correction algorithm to one or more standoff samples from the obtained field measurements, wherein the eccentricity correction algorithm produces a shape fitted curve that represents the borehole with a least number of points outside of the shape fitted curve and a least amount of error;

determine eccentricity-corrected borehole coordinates with the applied eccentricity correction algorithm;

determine a borehole shape from the eccentricity-corrected borehole coordinates; and determine tool location coordinates relative to the borehole with the determined borehole shape, wherein the instructions which, when executed by the processor, further cause the computer to perform operations to apply the eccentricity correction algorithm, the operations comprising:

determine a number of points on an intact section of the shape fitted curve and an non- intact section of the shape fitted curve for a predetermined number of transducer firings;

determine a number of errors of the shape fitted curve for the predetermined number of transducer firings;

determine a hole center of the shape fitted curve based on the determined number of points on the shape fitted curve and the determined number of errors of the shape fitted curve; and determine a hole radius of the shape fitted curve based on a sum of the determined number of points and a sum of the determined number of errors for the predetermined number of transducer firings in a depth interval.

17. The non-transitory computer-readable medium of claim 16, wherein the instructions which, when executed by the processor, further cause the computer to:

deploy the predetermined number of transducer firings simultaneously at different angles of firing with a plurality of acoustic transducers of the caliper tool.

* * * * *